US012514420B2

(12) United States Patent
Schnitzer et al.

(10) Patent No.: US 12,514,420 B2
(45) Date of Patent: Jan. 6, 2026

(54) ROBOT FOR WET CLEANING OF A FLOOR SURFACE AND METHOD FOR CONTROLLING THE ROBOT

(71) Applicant: BSH Hausgeräte GmbH, Munich (DE)

(72) Inventors: Frank Schnitzer, Bad Neustadt (DE); Stefan Hassfurter, Maroldsweisach (DE)

(73) Assignee: BSH Hausgeräte GmbH, Munich (DE)

( * ) Notice: Subject to any disclaimer, the term of this patent is extended or adjusted under 35 U.S.C. 154(b) by 361 days.

(21) Appl. No.: 18/330,513

(22) Filed: Jun. 7, 2023

(65) Prior Publication Data

US 2023/0389765 A1 Dec. 7, 2023

(30) Foreign Application Priority Data

Jun. 7, 2022 (DE) ..... 10 2022 205 779.1

(51) Int. Cl.
*A47L 11/40* (2006.01)

(52) U.S. Cl.
CPC ..... *A47L 11/4011* (2013.01); *A47L 11/4008* (2013.01); *A47L 11/4066* (2013.01); *A47L 2201/06* (2013.01)

(58) Field of Classification Search
CPC ..... A47L 11/4011; A47L 2201/06
See application file for complete search history.

(56) References Cited

U.S. PATENT DOCUMENTS

| | | | | |
|---|---|---|---|---|
| 10,398,269 | B2 | 9/2019 | Hillen et al. | |
| 2014/0230179 | A1 | 8/2014 | Matsubara et al. | |
| 2021/0068524 | A1 | 3/2021 | VanTongeren | |
| 2023/0240499 | A1 * | 8/2023 | VanTongeren ..... | A47L 11/28 701/26 |

FOREIGN PATENT DOCUMENTS

| | | | |
|---|---|---|---|
| AU | 2018102050 | A4 | 1/2019 |
| CN | 114431785 | A | 5/2022 |
| DE | 102012108008 | A1 | 3/2014 |
| DE | 102014111217 | A1 | 2/2016 |
| DE | 102018200719 | A1 | 7/2019 |
| WO | 2008007830 | A1 | 1/2008 |
| WO | 2020226426 | A2 | 11/2020 |

OTHER PUBLICATIONS

U.S. Appl. No. 63/305,816, filed Feb. 2, 2022; all pages. (Year: 2022).*
CN 108852177 A with English translation; date filed Jun. 6, 2018; date published Nov. 23, 2018. (Year: 2018).*

* cited by examiner

*Primary Examiner* — Calvin Cheung
(74) *Attorney, Agent, or Firm* — Laurence A. Greenberg; Werner H. Stemer; Ralph E. Locher

(57) ABSTRACT

A method for controlling a robot for the wet cleaning of a floor surface includes traveling over the floor surface and wet cleaning a portion of the floor surface which has been traveled over. A degree of wetness of a portion of the floor surface to be traveled over by the robot is determined, and the portion is traveled over only when the degree of wetness is below a predetermined threshold value. A robot for wet cleaning of a floor surface is also provided.

9 Claims, 3 Drawing Sheets

ROBOT FOR WET CLEANING OF A FLOOR SURFACE AND METHOD FOR CONTROLLING THE ROBOT

CROSS-REFERENCE TO RELATED APPLICATION

This application claims the priority, under 35 U.S.C. § 119, of German Patent Application DE 10 2022 205 779.1, filed Jun. 7, 2022; the prior application is herewith incorporated by reference in its entirety.

FIELD AND BACKGROUND OF THE INVENTION

The present invention relates to a floor cleaning robot. The invention relates, in particular, to a method for the control of a robot which is configured for the wet cleaning of a floor surface.

A cleaning robot is configured to clean a floor surface. It is possible to carry out dry cleaning, for example by vacuuming, or wet cleaning in which a cleaning liquid can be distributed over the floor surface in order to remove dirt or to absorb the dirt. The liquid can then be substantially picked up again by the robot.

The cleaning robot has a drive wheel and is configured to travel over a predetermined route on the floor surface. A cleaning facility for the wet cleaning of the floor surface is generally located downstream of the drive wheel so that no wheel marks remain on the treated surface. In practical use, however, it is often impossible to avoid the situation where the cleaning robot travels back over a surface which has already been treated, and as a result rolling marks of the drive wheel remain visible on the cleaned surface.

German Patent Application DE 10 2018 200 719 A1 proposes to analyze optically the state of a substrate which is to be traveled over by a cleaning robot. The cleaning robot can then be controlled as a function of the result of the analysis.

German Patent Application DE 10 2014 111 217 A1, corresponding to U.S. Pat. No. 10,398,269, relates to a control of a cleaning robot in such a way that initially a first cleaning step is carried out on the floor surface, followed by a second cleaning step. The first step can include, in particular, dry cleaning and the second step can include wet cleaning.

U.S. Publication No. 2014/0230179 A1 describes a method for controlling a robot in which a degree of wetness of a portion of the floor surface to be traveled over is determined.

U.S. Publication No. 2021/0068 524 A1 describes, among other things, a robot which includes sensors which detect the state of the floor to be cleaned.

German Patent Application DE 10 2012 108 008 A1 describes a vacuum appliance which has a sensor for detecting the properties of an environment of the vacuum appliance.

SUMMARY OF THE INVENTION

It is accordingly an object of the invention to provide a robot for wet cleaning of a floor surface and a method for controlling the robot, which overcome the hereinaforementioned disadvantages of the heretofore-known robots and methods of this general type and which provide an improved technique for the high-quality cleaning of a floor surface by using a cleaning robot.

The invention achieves this object by the subject matter of the independent claims. The dependent claims describe preferred embodiments.

With the foregoing and other objects in view there is provided, in accordance with the invention, a method for controlling a robot for the wet cleaning of a floor surface, comprising the steps of traveling over the floor surface and wet cleaning the floor surface which has been traveled over; determining a degree of wetness of a portion of the floor surface to be traveled over by the robot; and traveling over the portion only when the degree of wetness is below a predetermined threshold value.

In this manner it can be ensured that the robot leaves no marks behind on a damp or wet portion of the floor surface, which can be brought about, for example, by a drive wheel or a support wheel. The floor surface can be left without streaks and without marks in an improved manner.

Preferably, the portion to be traveled over has been previously treated by the robot. It is possible for the robot to have wet cleaned the portion so that a degree of wetness of the portion is caused by the robot itself. By avoiding traveling over the wet portion, the drive wheel can remain clean and dry and can have improved adhesion to the floor surface. As a result, the robot can navigate more accurately or travel more rapidly.

The degree of wetness of the portion can be determined by a sensor attached to the robot. The sensor can operate, for example, optically, capacitively or resistively. A portion to be traveled over, which is wet for reasons other than a treatment carried out by the robot, can also be determined by the sensor. For checking the degree of wetness, the robot can travel more slowly or stop. On other regions the robot can maintain its usual treatment speed without carrying out measurements.

In a further embodiment, a degree of wetness of the portion can be determined on the basis of a cleaning of the portion which has already been carried out. The robot can note in an internal memory which portions of the floor surface it has already wet cleaned. Traveling over such a portion can thus be prevented.

In a further preferred embodiment, the degree of wetness of the portion is determined on the basis of a time period which is between the cleaning which has already been carried out and the planned travel over the portion. Thus, for example, a portion which has been wet cleaned approximately five minutes ago can be determined as sufficiently dry. A portion which has only been wet cleaned a few seconds ago, however, can be determined as still too wet to be traveled over by the robot. If there is no other option available, the robot can stop and pause until the portion has had sufficient opportunity to dry. The predetermined time period can be established on the basis of an ambient temperature and/or an air humidity.

The degree of wetness of the portion can also be determined on the basis of a state of the floor surface on the portion to be traveled over. For example, a marble tile can dry more rapidly than parquet or linoleum. Further possible substrates include a wooden floor which can be untreated, oiled or sealed, cork, screed, concrete or glazed or unglazed tiles. In each case, the surfaces of the substrates can be treated or coated differently.

In a similar embodiment, a time period to be maintained between the cleaning which has already been carried out and the planned travel over the portion can be determined as a function of the state of the floor surface. In each case, a predetermined time period can be assigned to the various predetermined states. This time period can be determined as a function of an environmental influence, in particular an air humidity or an ambient temperature.

In yet another embodiment, the degree of wetness of the portion is determined on the basis of the wet cleaning previously carried out in this portion. Thus it can be taken into account when and how the robot itself has wetted the portion. If the robot cleans the portion, for example, repeatedly or particularly intensively it can be assumed that a longer time period is required until the degree of wetness is sufficiently low for the portion to be traveled over.

In yet another embodiment, a route which is guided over the floor surface is planned in such a way that as far as possible a treated portion is traveled over only when its degree of wetness is below the threshold value. In other words, the route can be guided in such a way that the predetermined time period is maintained between a portion being cleaned and subsequently being traveled over. The robot can treat a different portion of the floor surface between these two points in time.

Generally it should be noted that a portion of the floor surface treated by the robot can only be regarded as wet if the robot has wet cleaned the portion. For example, if the robot does not deploy an incorporated mopping facility on the portion or simply dry cleans the portion, for example by using a suction unit, the treated portion can be considered as unchanged or dry.

With the objects of the invention in view, there is also provided a robot for the wet cleaning of a floor surface, comprising a drive facility for traveling over the floor surface; a cleaning facility for the wet cleaning of a portion of the floor surface which is traveled over; and a treatment facility. The treatment facility is configured to determine a degree of wetness of a portion of the floor surface to be traveled over by the robot and to travel over the portion only when the degree of wetness is below a predetermined threshold value.

The treatment facility can be configured to perform a method wholly or partially as described herein. To this end, the treatment facility can include a programmable microcomputer or microcontroller and the method can be in the form of a computer program product with program coding. The computer program product can also be stored on a computer-readable data carrier. Features or advantages of the method can be transferred to the apparatus or vice versa.

The robot can additionally be configured for the dry cleaning of the floor surface. In one embodiment, the robot can initially dry clean and only subsequently wet clean the floor surface. A dry cleaning of the floor surface is generally substantially independent of the wet cleaning so that only the wet cleaning is described herein.

The treatment facility can determine the degree of wetness of the portion to be traveled over relative to a wet cleaning of the portion which has already been carried out. In a further embodiment which can be combined with this method, the robot includes a sensor for determining the degree of wetness of the portion to be traveled over. The sensor can include, for example, an infrared sensor, a camera, a resistive sensor or a capacitive sensor. Preferably, the sensor is configured to detect a portion of the floor surface located directly upstream of the robot in order to determine the degree of wetness thereof. The scanning can take place in a contactless manner.

Other features which are considered as characteristic for the invention are set forth in the appended claims.

Although the invention is illustrated and described herein as embodied in a robot for wet cleaning of a floor surface and a method for controlling the robot, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
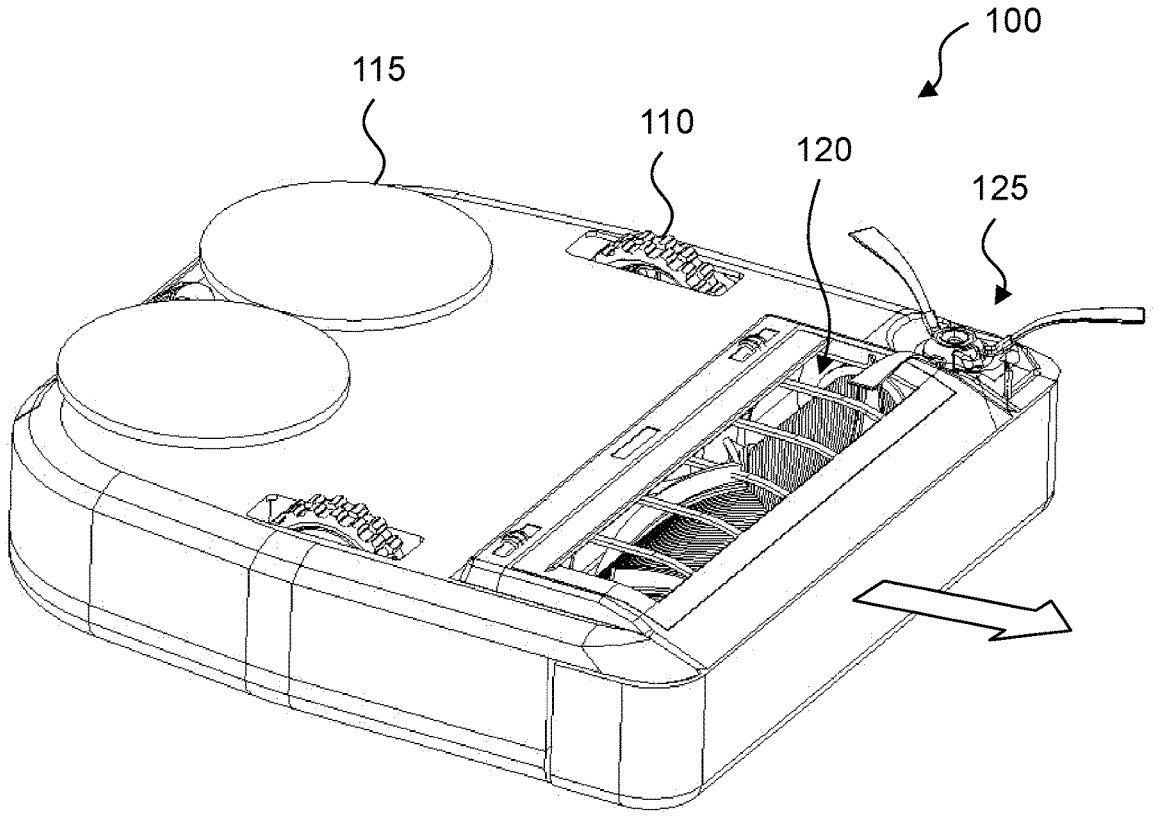
FIGS. 1 and 2 are respective diagrammatic perspective and longitudinal-sectional views of a robot for cleaning a floor surface.
Figure 2:
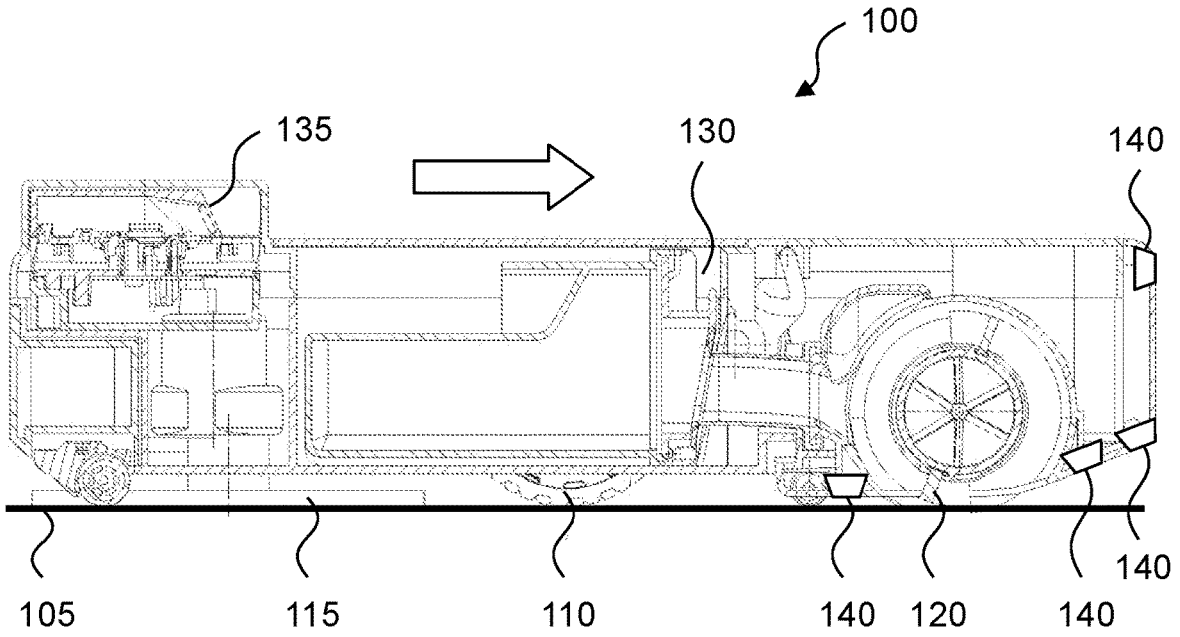

Referring now to the figures of the drawings in detail and first, particularly, to FIGS. 1 and 2 thereof, there is seen an exemplary robot 100 for cleaning a floor surface 105. A lower face of the robot 100 is shown in FIG. 1 and a longitudinal section is shown in FIG. 2. A block arrow in each case shows a forward direction of travel.

The robot 100 has at least one drive wheel 110, a first cleaning facility 115, an optional second cleaning facility 120 and a further optional third cleaning facility 125.

The first cleaning facility 115 is preferably located downstream of the drive wheel 110 relative to the usual direction of travel; the second and/or third cleaning facility 120, 125 can also be located downstream of the drive wheel or even upstream of the drive wheel. Optionally, a support wheel or a skid is provided upstream of the first cleaning facility 115. The arrangement is preferably selected in such a way that no elements which could come into contact with the floor surface 105 or impair an already achieved cleaning result of the floor surface 105 are attached to the robot 100 downstream of the first cleaning facility 115.

The first cleaning facility 115 is configured to wet clean the floor surface 105. To this end, a liquid container in which liquid is received can be carried on board the robot 100, the liquid being distributed over the floor surface 105 in the region of the first cleaning facility 115. An element of the first cleaning facility 115 which is configured to be guided along the floor surface 105, for example a tile or textile, can additionally be moved, for example, in a circular manner, a linear manner or in the shape of a cycloid. In one embodiment, the first cleaning facility 115 can be activated or deactivated. For the deactivation, the first cleaning facility can be lifted away from the floor surface 105 and for the activation it can be lowered back onto the floor surface.

The optional second cleaning facility 120 is preferably configured for the dry cleaning of the floor surface 105. In the embodiment shown, the second cleaning facility 120 includes a brush roller which can be optionally assisted by a suction unit in the manner of a vacuum cleaner. The optional third cleaning facility 125 in this case includes a brush or sweeping device which can be rotated about a vertical axis and which can be deployed, in particular in combination with the second cleaning facility 120, in order to dry clean the floor surface 105 as far as possible without any gaps up to an obstacle.

A treatment facility 130 is configured to control the robot 100 on the floor surface 105 and to deploy the cleaning facilities 115 to 125 in a suitable manner. In one embodiment, the floor surface 105 is initially dry cleaned by the second and/or third cleaning facility 120, 125 and only then wet cleaned by using the first cleaning facility 115.

In order to scan an environment, it is possible to provide a first sensor 135 which can include, for example, a camera or a lidar sensor. Further possible sensors 135 include a radar sensor, an inertial platform, a gyroscope or a rotational sensor on a drive wheel. A plurality of first sensors 135 can also be provided. The treatment facility 130 can determine a position of the robot 100 and the position of an obstacle on the floor surface 105 on the basis of scans from the first sensor 135. Optionally, the treatment facility 130 can also determine a route for traveling over the floor surface 105 on the basis of the scans.

Preferably, a second sensor 140 is provided, the second sensor being configured to determine a degree of wetness of a portion of the floor surface 105 which is located upstream of the robot 100 in the direction of travel. To this end, the second sensor 140 is preferably disposed upstream of the drive wheel 110. The second sensor 140 can include, for example, an infrared sensor, a camera, a resistive sensor, a capacitive sensor, an air humidity sensor, a sensor for detecting a gloss level or an optical sensor which scans the floor surface in a similar manner to that known from a computer mouse.

Depending on the measuring principle, the second sensor 140 can be attached, for example, to a front boundary of the robot 100, wherein a scanning range is generally oriented obliquely to the front onto the floor surface 105. In a further embodiment, the second sensor 140 can be disposed in a lower region of the robot 100, for example upstream or downstream of the second cleaning facility 120. Generally, the sensor 140 is preferably configured to be attached to the robot 100 in such a way that it can determine a portion of the floor surface 105 which is still wet, even before an element of the robot 100 has left marks behind on the wet portion. The second sensor 140 is thus preferably deployed upstream of the drive wheel 110 and all possible support wheels, skids or treatment facilities 120, 125 which could leave a mark behind on a wet portion of the floor surface 105.

Figure 3:
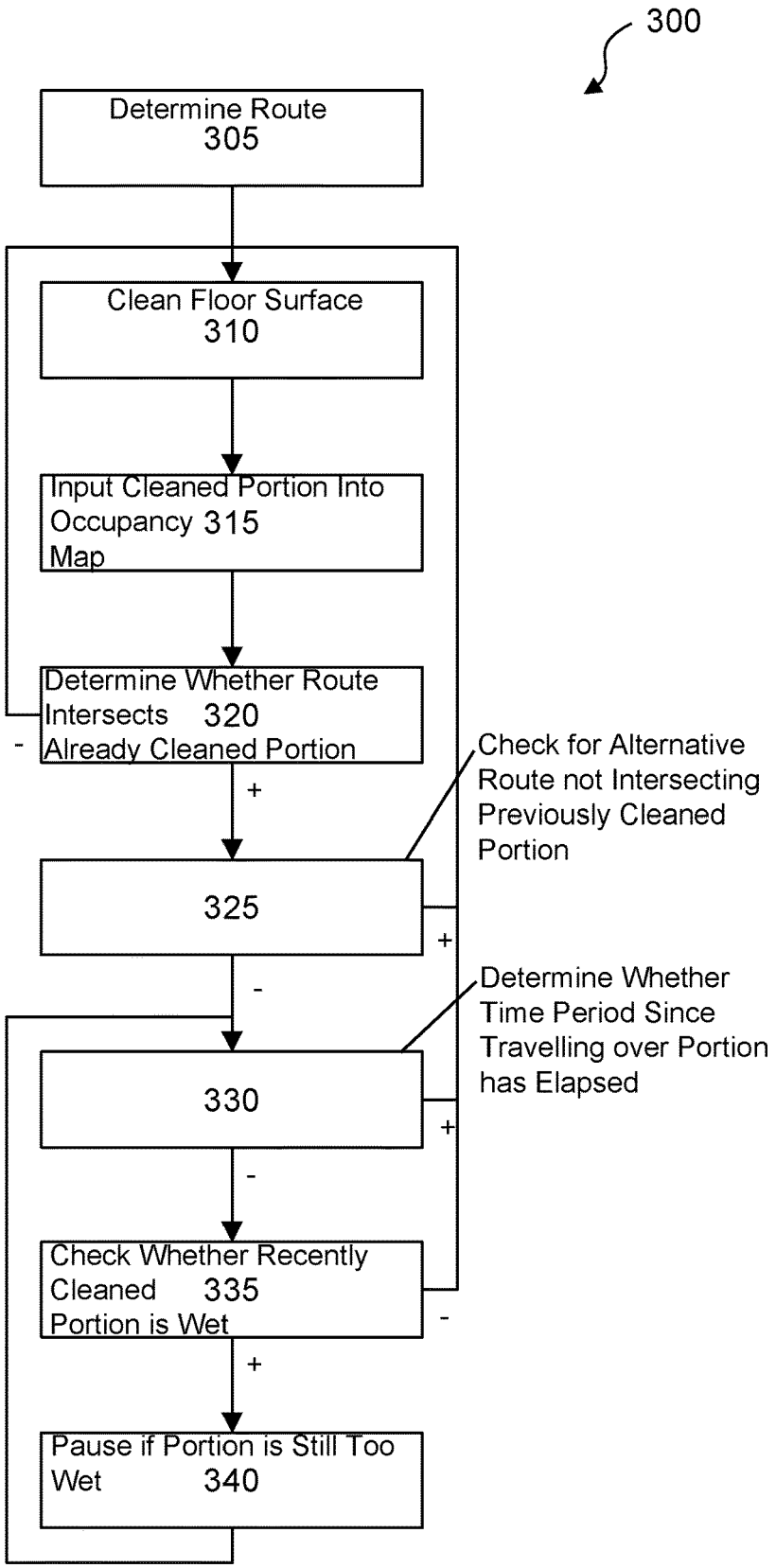
FIG. 3 is a flow diagram of a method for controlling a robot.

FIG. 3 shows a flow diagram of a method 300 for controlling a robot 100. The method 300 can be carried out, in particular, by using a treatment facility 130 on board the robot 100.

In a step 305 a route can be determined for the robot 100. The route is preferably guided over a floor surface 105 in such a way that free regions can be cleaned without gaps when traveled over by the robot 100, wherein a distance covered on the floor surface is preferably minimized in terms of its length. The route can also be optimized relative to other parameters. In one embodiment, the route is determined in such a way that as far as possible the paths thereof rarely intersect. To this end, it is possible to avoid a portion of the floor surface 105 which has already been treated, or an increased cost function can be applied thereto. Further preferably, the route runs in a meandering manner. In one embodiment, it is desired that the route includes a series of tracks which are parallel to one another so that the floor surface 105 can be cleaned as far as possible without streaks and as thoroughly as possible.

In a step 310 a cleaning of the floor surface 105 can be carried out. To this end, the robot 100 can travel on the floor surface 105 along the specified route and use the first cleaning facility 115 to undertake a wet cleaning. A dry cleaning can take place at the same time or in the same operation, or can have already been carried out at an earlier point in time.

In a step 315 a cleaned portion of the floor surface 105 can be input into an occupancy map. An exemplary occupancy map is described in more detail with reference to FIG. 4.

In a step 320 it can be determined whether the predetermined route intersects a portion of the route which has already been cleaned. In particular, it can be checked whether a portion of the floor surface 105 which is located immediately upstream of the robot 100 in the direction of travel has already been cleaned. This determination can be made by using the occupancy map. If the portion has not yet been cleaned, the method can be continued with the step 310.

Otherwise, if a portion which has already been cleaned is located upstream of the robot 100, it can be checked in a step 325 whether an alternative route which does not intersect a previously cleaned portion is possible. If this is the case, the route can be correspondingly determined or adapted and the method 300 can continue with the step 310.

Otherwise, if no alternative route can be determined, in a step 330 it can be determined whether a time period, which is longer than a predetermined time period, has already elapsed since the portion to be traveled over by the robot 100 was cleaned. If this is the case, the portion can be traveled over without the risk of leaving marks behind on the portion. The method 300 in this case can continue with the step 310.

Otherwise, if the last cleaning has only recently taken place, it can be checked in a step 335 whether the portion to be traveled over is wet. To this end, the portion can be monitored for its degree of wetness by using the second sensor 140. If the degree of wetness is below a predetermined threshold value, the portion can be traveled over and the method can be continued with the step 310. If it is determined that the measured degree of wetness of the portion does not coincide with the degree of wetness determined on the basis of the drying period, the predetermined time period can be adapted. In this case, it is possible to consider a state of the floor surface 105 on the portion.

Otherwise, if the portion to be traveled over is still too wet, in a step 340 it is possible to pause until the degree of wetness of the portion has fallen below the predetermined threshold value or the predetermined time has elapsed.

It should be noted that the steps of the method shown are not necessarily carried out in the described sequence and not all of the aforementioned steps in the method 300 have to be carried out. The degree of wetness of a portion of the floor surface 105, relative to the time elapsed since the previous wet cleaning, can be determined in an additional or alternative manner to a determination of the degree of wetness using measuring technology by using the second sensor 140. The determination of an alternative route can take place only when one or more tests indicate that a degree of wetness of the portion to be traveled over is too high. The pause in step 340, which is the most rarely selected alternative, is preferred if a portion of the floor surface 105 to be treated has a degree of wetness which is too high.

Figure 4:
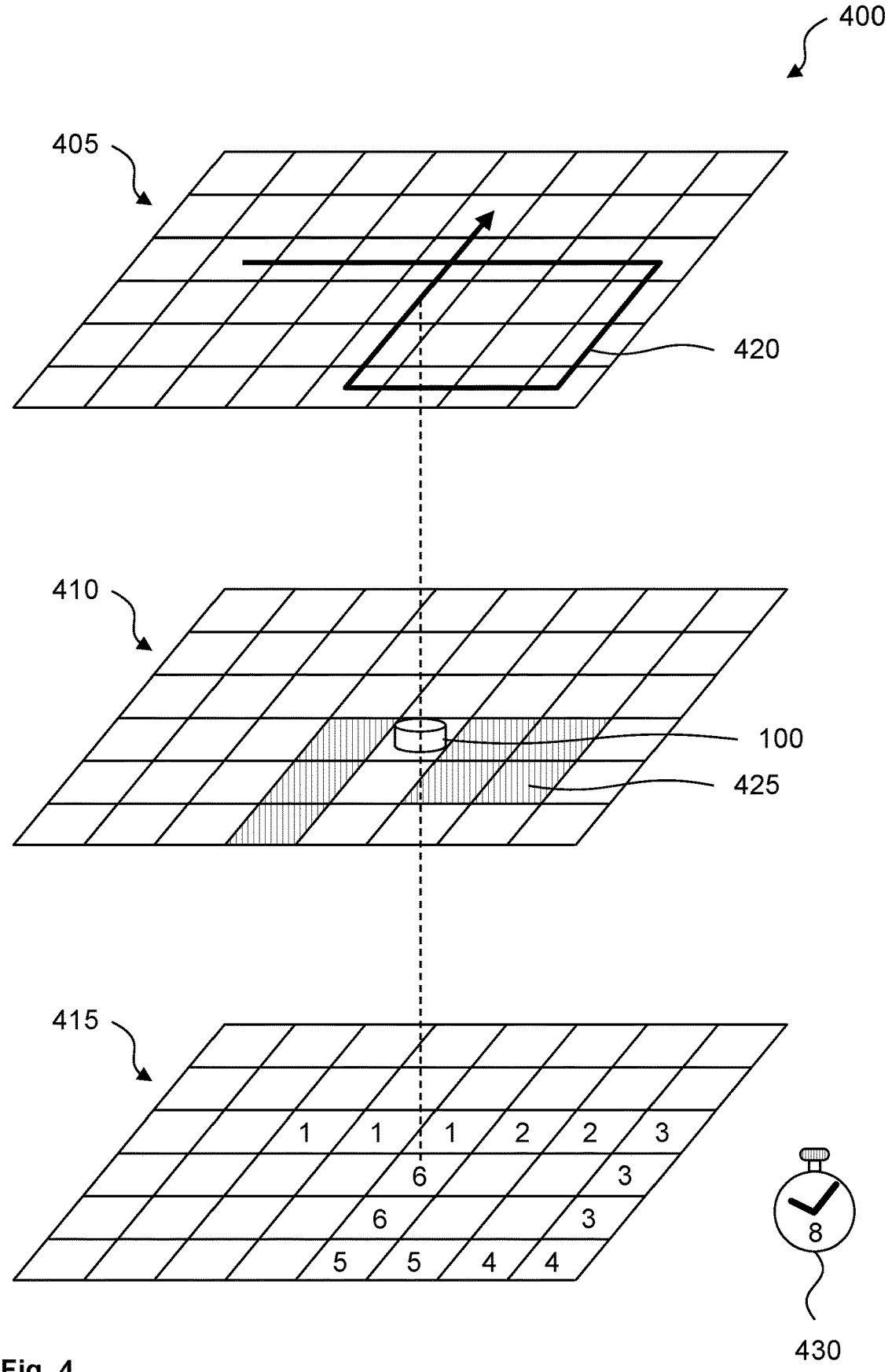
FIG. 4 is a perspective view of an exemplary occupancy map for a cleaning robot.

*FIG. 4 shows an exemplary occupancy map 400 which can be used for navigation or route determination for the robot 100. By way of example, three planes 405, 410 and 415 are provided, the planes in each case covering the same physical area but representing different information. The occupancy map 400 is divided in all planes 405 to 415 into a predetermined grid of fields which in each case correspond to a portion of the floor surface 105. For improved understanding of the view, a vertical dashed line is illustrated which vertically connects together three exemplary fields of the planes 405-415 corresponding to one another. The occupancy map 400 can illustrate, for example, a household or a room of a household in which the robot 100 is configured to be deployed.

A route 420 is illustrated in the first plane 405. The route 420 runs from a predetermined starting point generally in a meandering manner over the floor surface 105 so that each portion is traveled over at least once and preferably not more frequently than once by the robot 100 and is able to be cleaned at the same time. If different cleaning passes are to take place, for example a dry cleaning pass and a wet cleaning pass, a route 420 can be determined for the dry cleaning pass according to any known method. The route 420 shown for the wet cleaning pass is preferably determined in such a way that it includes as few points as possible which intersect with one another. Other optimization goals can also be applied.

The second plane 410 contains obstacles 425 which can include, for example, a wall, a piece of furniture or a long-pile carpet. Optionally it is possible to differentiate between an obstacle 425 which can be traveled over but is not to be cleaned and one which cannot be traveled over. When traveling over an obstacle 425 which is not to be cleaned, the first cleaning facility 115 can be deactivated.

The third plane 415 can contain binary values which indicate whether the robot 100 has already visited the corresponding portion of the floor surface 105 in the present cleaning pass. If this is the case, this is referred to as an intersecting route. Before the cleaning pass, all of the fields can be set to a predetermined value.

In the embodiment shown, which is accordingly refined, the third plane 415 contains in each case in the individual fields an input which indicates a point in time at which the corresponding portion of the floor surface 105 was last wet cleaned by the robot 100. Unoccupied fields can also be initialized in this case with a predetermined value which indicates that the portion has not yet been treated in the current cleaning pass. When traveling over the floor surface 105, a field of the third plane 415 which corresponds to a treated portion of the floor surface 105 can be provided with an input which indicates a current point in time. The input can include, in particular, a time stamp which optionally also contains a date.

In order to generate the time stamp, a timer 430 can be carried on board the robot 100. The input of the current time stamp in the corresponding field of the third plane 415 can be carried out when entering the portion, during the treatment or when leaving the portion. In the embodiment shown, purely by way of example, time stamps ranging from 1 to 6 are input. Time increments between successive time stamps can be in each case, for example, one second or a different predetermined value.

If the robot 100 is about to travel over a portion of the floor surface 105 which corresponds to an already occupied field of the third plane 415, it can be determined how much time has passed between the treatment of the portion already carried out and the current point in time, by the time marked in the field being subtracted from a current time of the timer 430. In the present example, the portion of the floor surface 105 to be traveled over has been wet cleaned 8−1=7 time increments ago.

In one embodiment, a time period which is generally sufficient in order to allow a wet cleaned portion of the floor surface 105 to dry again is predetermined. In the present example, if this time period is seven or less, the robot can continue to follow the route 420. If the predetermined time period, however, is eight or more, the robot 100 has to pause until the predetermined drying time has been reached. In the example shown, the robot cannot set an alternative route 420 since obstacles 425 are located to the right and left of the robot and a field located downstream of the robot has also already been wet cleaned.

If the robot 100 has completed its cleaning pass of the floor surface 105, in each field of the occupancy map 400 either an obstacle 425 can be present in the second plane 410 or a time stamp can be present in the third plane 415. The values of the third plane 415 can be deleted after the cleaning pass or set to a predetermined value or maintained for a subsequent cleaning pass. The timer 430 preferably runs continuously, even between cleaning passes.

The following is a summary list of reference numerals and the corresponding structure used in the above description of the invention:

100 Robot
105 Floor surface
110 Drive wheel
115 First cleaning facility, wet
120 Second cleaning facility, dry
125 Third cleaning facility, dry
130 Treatment facility
135 First sensor, scanning of an environment
140 Second sensor, determining a degree of wetness
300 Method
305 Determine route
310 Carry out cleaning
315 Input cleaned portion in occupancy map
320 Route intersects cleaned portion?
325 Alternative route possible?
330 Cleaning sufficiently long ago?
335 Floor wet?
340 Pause
400 Occupancy map
405 First plane: route
410 Second plane: occupancy
415 Third plane: cleaning times
420 Route
425 Obstacle
430 Timer

The invention claimed is:

1. A method for controlling a robot for wet cleaning of a floor surface, the method comprising:

causing the robot to travel over the floor surface and wet clean a portion of the floor surface having been traveled over;

determining a degree of wetness of the portion of the floor surface of the floor surface to be traveled over by the robot;

causing the robot to travel over the portion of the floor surface only upon the degree of wetness being below a predetermined threshold value;

planning a route to be guided over the floor surface to ensure that as far as possible a treated portion of the floor surface is traveled over only upon a degree of wetness of the treated portion of the floor surface being below a threshold value;

determining whether the route intersects a portion of the route having already been cleaned; and upon the portion having already been cleaned being located upstream of the robot, checking whether an alternative route not intersecting a previously cleaned portion of the floor surface is possible.

2. The method according to claim 1, which further comprises using a portion of the floor surface having been previously treated by the robot as the portion of the floor surface to be traveled over.

3. The method according to claim 1, which further comprises using a sensor attached to the robot to determined the degree of wetness of the portion of the floor surface.

4. The method according to claim 1, which further comprises determining the degree of wetness of the portion of the floor surface based on a cleaning of the portion of the floor surface having already been carried out.

5. The method according to claim 4, which further comprises determining the degree of wetness of the portion of the floor surface based on a time period between the cleaning having already been carried out and a planned travel over the portion of the floor surface.

6. The method according to claim 4, which further comprises determining the degree of wetness of the portion of the floor surface based on a state of the floor surface in the portion of the floor surface.

7. The method according to claim 4, which further comprises determining the degree of wetness of the portion of the floor surface based on a wet cleaning having been previously carried out in the portion of the floor surface.

8. A robot for wet cleaning of a floor surface, the robot comprising:

a driver for causing the robot to travel over the floor surface;

a cleaner for wet cleaning of a portion of the floor surface to be traveled over; and a treater configured to determine a degree of wetness of the portion of the floor surface to be traveled over by the robot and configured to cause the robot to travel over the portion of the floor surface only upon the degree of wetness being below a predetermined threshold value;

said treater planning a route to be guided over the floor surface to ensure that as far as possible a treated portion of the floor surface is traveled over only upon a degree of wetness of the treated portion of the floor surface being below a threshold value;

said treater determining whether the route intersects a portion of the route having already been cleaned; and said treater, upon the portion having already been cleaned being located upstream of the robot, checking whether an alternative route not intersecting a previously cleaned portion of the floor surface is possible.

9. The robot according to claim 8, which further comprises a sensor for determining the degree of wetness of the portion of the floor surface to be traveled over.

* * * * *